US011138923B2

(12) United States Patent
Li et al.

(10) Patent No.: US 11,138,923 B2
(45) Date of Patent: Oct. 5, 2021

(54) PIXEL CIRCUIT, DRIVING METHOD THEREOF AND DISPLAY APPARATUS

(71) Applicant: BOE Technology Group Co., Ltd., Beijing (CN)

(72) Inventors: Shengnan Li, Beijing (CN); Wei Qin, Beijing (CN); Tieshi Wang, Beijing (CN); Weixing Liu, Beijing (CN); Chunfang Zhang, Beijing (CN); Wanpeng Teng, Beijing (CN); Dongni Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/891,124

(22) Filed: Jun. 3, 2020

(65) Prior Publication Data

US 2021/0150975 A1 May 20, 2021

(30) Foreign Application Priority Data

Nov. 15, 2019 (CN) ..... 201911119781.5

(51) Int. Cl.
*G09G 3/32* (2016.01)

(52) U.S. Cl.
CPC ..... *G09G 3/32* (2013.01); *G09G 2300/0819* (2013.01); *G09G 2310/06* (2013.01); *G09G 2330/04* (2013.01)

(58) Field of Classification Search
CPC ..... G09G 3/32; G09G 2300/0819; G09G 2310/06; G09G 2330/04; G09G 3/3208; G09G 3/006
See application file for complete search history.

(56) References Cited

U.S. PATENT DOCUMENTS

2007/0114918 A1* 5/2007 Arai ..... G09G 3/006 313/504
2012/0248471 A1* 10/2012 Kishi ..... G09G 3/3233 257/88

(Continued)

FOREIGN PATENT DOCUMENTS

CN 102832805 A 12/2012
CN 103680392 A 3/2014

(Continued)

OTHER PUBLICATIONS

First office action of Chinese application No. 201911119781.5 dated Jul. 27, 2020.

*Primary Examiner* — Christopher J Kohlman
(74) *Attorney, Agent, or Firm* — Fay Sharpe LLP

(57) ABSTRACT

A pixel circuit, a driving method thereof and a display apparatus are provided. The pixel circuit comprises a control module, a short-circuit protection module, a drive transistor and a light-emitting device, wherein the short-circuit protection module is used for providing a data voltage to a gate of the drive transistor in response to a gate signal; a second pole of the drive transistor is connected to a positive pole of the light-emitting device, and a negative pole of the light-emitting device receives a second power supply voltage; the short-circuit protection module is used for providing a third power supply voltage to the gate of the drive transistor to turn off the drive transistor in response to the data voltage provided to the gate of the drive transistor and the second power supply voltage provided to the positive pole of the light-emitting device.

20 Claims, 7 Drawing Sheets

(56) References Cited

U.S. PATENT DOCUMENTS

| | | | | |
|---|---|---|---|---|
| 2012/0293562 | A1 | 11/2012 | Park | |
| 2014/0084792 | A1 | 3/2014 | Oh et al. | |
| 2014/0362063 | A1 | 12/2014 | Uchino et al. | |
| 2016/0253011 | A1 | 9/2016 | Yang et al. | |
| 2017/0301290 | A1* | 10/2017 | Qing | G09G 3/3233 |
| 2018/0301094 | A1* | 10/2018 | Liu | G09G 3/3266 |
| 2019/0005878 | A1* | 1/2019 | Yue | G09G 3/006 |
| 2019/0005881 | A1 | 1/2019 | Yue et al. | |
| 2021/0097908 | A1* | 4/2021 | Li | G01R 31/52 |

FOREIGN PATENT DOCUMENTS

| | | | |
|---|---|---|---|
| CN | 106448564 | A | 2/2017 |
| CN | 106531071 | A | 3/2017 |
| CN | 106531080 | A | 3/2017 |
| CN | 108682385 | A | 10/2018 |
| CN | 110097842 | A | 8/2019 |
| CN | 110416270 | A | 11/2019 |
| CN | 110580876 | A | 12/2019 |
| KR | 20190043372 | A | 4/2019 |

* cited by examiner

PIXEL CIRCUIT, DRIVING METHOD THEREOF AND DISPLAY APPARATUS

This application claims priority of Chinese Patent Application No. 201911119781.5, filed on Nov. 15, 2019 and entitled "PIXEL CIRCUIT, SHORT CIRCUIT DETECTION METHOD AND DISPLAY PANEL", the entire contents of which are incorporated by reference in the present application.

TECHNICAL FIELD

The present disclosure relates to the field of display technologies, in particular to a pixel circuit, a driving method thereof and a display apparatus.

BACKGROUND

A micro light emitting diode (Micro-LED) is a micro LED obtained after thin filming and miniaturization on a conventional LED structure, and the volume of the Micro-LED is about 1 percent of the size of the conventional LED. When the micro light emitting diode is applied to a display panel as a light emitting unit, each pixel of the display panel, including a micro light emitting diode array, may be independently controlled and be driven to emit light. As an interval (at micrometer level) between two adjacent micro light emitting diode arrays is much smaller than that between two adjacent LED arrays, realization of higher pixels per inch (PPI), higher brightness and higher color saturation of the display panel is facilitated; and meanwhile, the micro light emitting diode further has the characteristics of high efficiency of devices, strong water and oxygen resistance and the like and is expected to become the next generation of mainstream display technologies.

SUMMARY

A pixel circuit, a driving method thereof and a display apparatus are provided.

In a first aspect, a pixel circuit is provided. The pixel circuit comprises a control module, a drive transistor, a light-emitting device and a short-circuit protection module, wherein the control module is connected to a data voltage line, a first power supply voltage line, a gate of the drive transistor and a first pole of the drive transistor, respectively, and the control module is used for providing a data voltage on the data voltage line to the gate of the drive transistor in response to a gate signal, and providing a first power supply voltage on the first power supply voltage line to the first pole of the drive transistor in response to a light-emitting turn-on signal;

a second pole of the drive transistor is connected to a positive pole of the light-emitting device, and a negative pole of the light-emitting device is connected to a second power supply voltage line; and the short-circuit protection module is connected to a third power supply voltage line, the gate of the drive transistor and the positive pole of the light-emitting device, respectively, and the short-circuit protection module is used for providing a third power supply voltage on a third power supply voltage line to the gate of the drive transistor to turn off the drive transistor in response to the data voltage being provided to the gate of the drive transistor and a second power supply voltage on the second power supply voltage line being provided to the positive pole of the light-emitting device;

wherein the first pole and the second pole are one of a source and a drain, respectively.

Optionally, the short-circuit protection module comprises a first transistor and a second transistor, wherein a gate of the first transistor is connected to the gate of the drive transistor, the first pole of the first transistor is connected to the positive pole of the light-emitting device, the second pole of the first transistor is connected to the gate of the second transistor, the first pole of the second transistor is connected to the gate of the drive transistor, and the second pole of the second transistor is connected to the third power supply voltage line.

Optionally, the control module comprises a third transistor, a fourth transistor and a storage capacitor, wherein a gate of the third transistor receives a light-emitting turn-on signal, a first pole of the third transistor is connected to the first power supply voltage line, and a second pole of the third transistor is connected to the first pole of the drive transistor;

a first end of the storage capacitor is connected to the gate of the drive transistor, and a second end of the storage capacitor is connected to the first pole of the third transistor; and a gate of the fourth transistor receives the gate signal, a first pole of the fourth transistor is connected to the data voltage line, and a second pole of the fourth transistor is connected to the gate of the drive transistor.

Optionally, the drive transistor is a P-type transistor, the third power supply voltage is equal to the first power supply voltage, the first power supply voltage is higher than the second power supply voltage, the light-emitting device is one of a Micro-LED, a Micro-OLED, an OLED and a LED, and the structure of the light-emitting device is one of a face-up structure, a face-down structure and a vertical structure.

Optionally, the first transistor is a NMOS transistor, and the second transistor, the third transistor, the fourth transistor and the drive transistor are all PMOS transistors.

Optionally, the first power supply voltage is higher than the second power supply voltage.

Optionally, the drive transistor is the P-type transistor, and the third power supply voltage is equal to the first power supply voltage.

Optionally, the light-emitting device is one of the Micro-LED, the Micro-OLED, the OLED and the LED, and the structure of the light-emitting device is one of the face-up structure, the face-down structure and the vertical structure.

In a second aspect, a driving method of any of the pixel circuits according to the first aspect is provided. The method includes:

in a writing phase in each display period, providing the data voltage to the data voltage line and providing the gate signal to the control module to enable the control module to provide the data voltage to the gate of the drive transistor in response to the gate signal, and enable the short-circuit protection module to provide the third power supply voltage to the gate of the drive transistor when the second power supply voltage is provided to the positive pole of the light-emitting device and in a light-emitting phase after the writing phase in each display period, providing the light-emitting turn-on signal to the control module to enable the control module to provide the first power supply voltage to the first pole of the drive transistor in response to the light-emitting turn-on signal, and enable the drive transistor to provide a drive current with a corresponding current value to the light-emitting device according to a voltage value of the data voltage when the short-circuit protection module does not provide the third power supply voltage to the gate of the drive transistor.

Optionally, the providing the data voltage to the data voltage line, comprises:

providing a data voltage with a first voltage value to the data voltage line to enable the short-circuit protection module to provide the third power supply voltage to the gate of the drive transistor in response to the data voltage with the first voltage value when the second power supply voltage is provided to the positive pole of the light-emitting device; and providing data voltage with a second voltage value, wherein the second voltage value is a voltage value generated based on a picture to be displayed.

In a third aspect a display apparatus is provided. The display apparatus comprises a drive circuit and a plurality of any of the pixel circuits according to the first aspect, and the plurality of pixel circuits are connected to the drive circuit, wherein the drive circuit comprises:

a gate drive sub-circuit; used for providing the gate signal to the control module to enable the control module to provide the data voltage to the gate of the drive transistor in response to the gate signal and enable the short-circuit protection module to provide the third power supply voltage to the gate of the drive transistor when the second power supply voltage is provided to the positive pole of the light-emitting device in the writing phase in each display period; and a source drive sub-circuit, used for providing the data voltage to the data voltage line in the writing phase in each display period, wherein the gate drive sub-circuit is further used for providing the light-emitting turn-on signal to the control module to enable the control module to provide the first power supply voltage to the first pole of the drive transistor in response to the light-emitting turn-on signal and enable the drive transistor to provide a drive current with a corresponding current value to the light-emitting device according to a voltage value of the data voltage when the short-circuit protection module does not provide the third power supply voltage to the gate of the drive transistor in the light-emitting phase after the writing phase in each display period.

Optionally, the source drive sub-circuit is further used for:

providing a data voltage with a first voltage value to the data voltage line to enable the short-circuit protection module to provide the third power supply voltage to the gate of the drive transistor in response to the data voltage with the first voltage value when the second power supply voltage is provided to the positive pole of the light-emitting device; and providing data voltage with a second voltage value, wherein the second voltage value is a voltage value generated based on a picture to be displayed.

In a fourth aspect; a display apparatus is provided. The display apparatus comprises a plurality of any of the pixel circuits according to the first aspect in a display region of the display apparatus.

DETAILED DESCRIPTION

Figure 1:
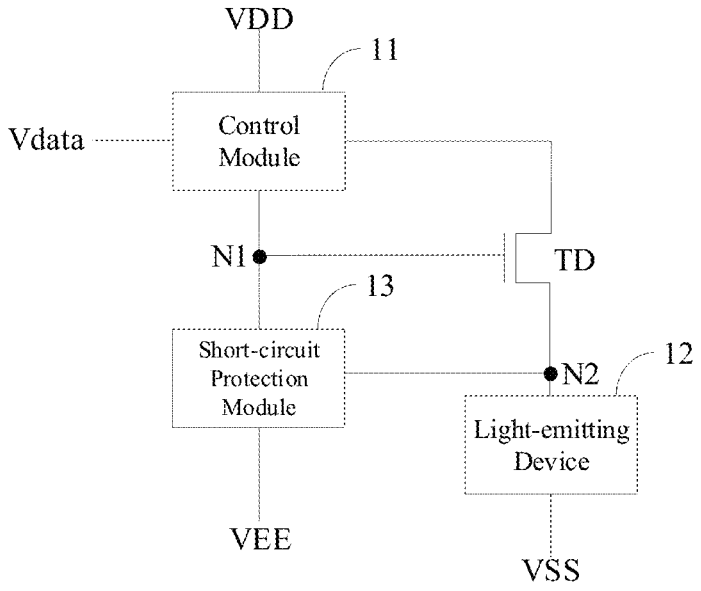
FIG. 1 is a structure block diagram showing a pixel circuit provided by an embodiment of the present disclosure.

In order to describe the present disclosure more clearly, the present disclosure will be further described below with reference to preferred embodiments and accompanying drawings. Similar parts in the drawings are represented by the same reference numerals. Those skilled in the art should understand that the content specifically described below is illustrative and not restrictive, and should not be constructed as limiting the protection scope of the present disclosure.

In related arts, a Micro-LED chip in a Micro-LED display apparatus is electrically connected to a backplane after being transferred and has the short circuit risk to a certain degree after transferred in massive amounts. When a short circuit of a micro light emitting diode occurs, a very great current is formed in the backplane, and thus the backplane may be probably damaged, and the yield of products is lowered. About the problem, the embodiment of the present disclosure provides a pixel circuit, a driving method thereof and a display apparatus, in which protection is triggered when the condition of a short circuit is detected by the short-circuit protection module to avoid formation of a large current caused by the short circuit, and thus damages caused by the short circuit of the micro light emitting diode may be avoided, increase in yield of related display products is facilitated, and the safety of the display apparatus in the manufacturing process and during use is improved.

FIG. 1 is a structure block diagram showing a pixel circuit provided by an embodiment of the present disclosure. Referring to FIG. 1, the pixel circuit includes a control module 11, a drive transistor TD, a light-emitting device 12 and a short-circuit protection module 13.

The control module 11 is connected to a data voltage line (which is a voltage line used for transmitting a data voltage Vdata), a first power supply voltage line (which is a voltage line used for transmitting a first power supply voltage VDD), a gate of the drive transistor TD and a first pole of the drive transistor TD. The first pole and a second pole are a source and a drain respectively herein. For example, the first pole may totally refer to the drain, and the second pole may totally refer to the source; or the first pole may totally refer to the drain, and the second pole may totally refer to the source. It should be noted that according to different concrete types of transistors, connection relationships of the source and the drain of each transistor may be set respectively to be matched with a direction of a current flowing through the transistor; and when the transistor is of a structure with symmetric source and drain, the source and the drain may be regarded as two poles without special distinctions. The control module 11 is used for provide a data voltage Vdata on the data voltage line to the gate of the drive transistor TD in response to a gate signal Gate and providing the first power supply voltage VDD on the first power supply voltage line to the first pole of the drive transistor TD in response to a light-emitting turn-on signal EM. The second pole of the drive transistor is connected to a positive pole of the light-emitting device 12, a negative pole of the light-emitting device 12 is connected to a second power supply voltage line to enable a second power supply voltage VSS on the second power supply voltage line to be applied to the negative pole of the light-emitting device 12, and thus a drive current can be formed between the first power supply voltage line and the second power supply voltage line to enable the light-emitting device 12 to emit light when the drive transistor TD works in a linear region or a saturation region.

In an example, the control module 11 provides the data voltage Vdata to the gate of the drive transistor TD when the gate signal Gate is low, and thus writing of the data voltage Vdata is finished; and the control module 11 provides the first power supply voltage VDD to the first pole of the drive transistor TD when the light-emitting turn-on signal EM is low, and thus the drive transistor TD provides a drive current with a corresponding current value to the light-emitting device 12 according to a voltage value of the data voltage Vdata, and controlling the luminescence of the light-emitting device 12 is realized.

The short-circuit protection module 13 is connected to a third power supply voltage line (used for transmitting a third power supply voltage VEE), the gate of the drive transistor TD and the positive pole of the light-emitting device 12 and is used for providing the third power supply voltage VEE on the third power supply voltage line to the gate of the drive transistor TD to turn off the drive transistor TD in response to the data voltage Vdata provided to the gate of the drive transistor TD and the second power supply voltage VSS, provided to the positive pole of the light-emitting device 12, on the second power supply voltage line.

In an example, the short-circuit protection module 13 may detect whether the second power supply voltage VSS is provided to the positive pole of the light-emitting device 12 or not when the control module 11 provides the data voltage Vdata to the gate of the drive transistor TD (normally, voltage of the positive pole of the light-emitting device 12 may be higher than that of the negative pole, but the second power supply voltage VSS may be directly provided to the positive pole of the light-emitting device 12 when a short circuit occurs between the positive pole and the negative pole of the light-emitting device 12, and thus the voltage of the positive pole may be roughly equal to the second power supply voltage VSS). After the situation that the second power supply voltage VSS is provided to the positive pole of the light-emitting device 12 is determined, the short-circuit protection module 13 may provide the third power supply voltage VEE capable of turning off the drive transistor TD to the gate of the drive transistor TD. For example, as for the N-type drive transistor TD with the cut-off condition that a difference value obtained by subtracting a source voltage from a gate voltage is smaller than a threshold voltage Vth, a voltage value of the third power supply voltage VEE may be selected in a range smaller than VDD plus Vth according to the application demands.

It can be seen that the short-circuit protection module 13 may lock the drive transistor TD in a cut-off state when the short circuit occurs between the positive pole and the negative pole of the light-emitting device 12 to avoid the situation that a short-circuit current is formed between the first power supply voltage line and the second power supply voltage line, and therefore, damages caused by the short circuit of a micro light emitting diode may be helped to be avoided, increase in yield of related display products is facilitated, and the safety of the display apparatus in the manufacturing and using process is improved.

Figure 2:
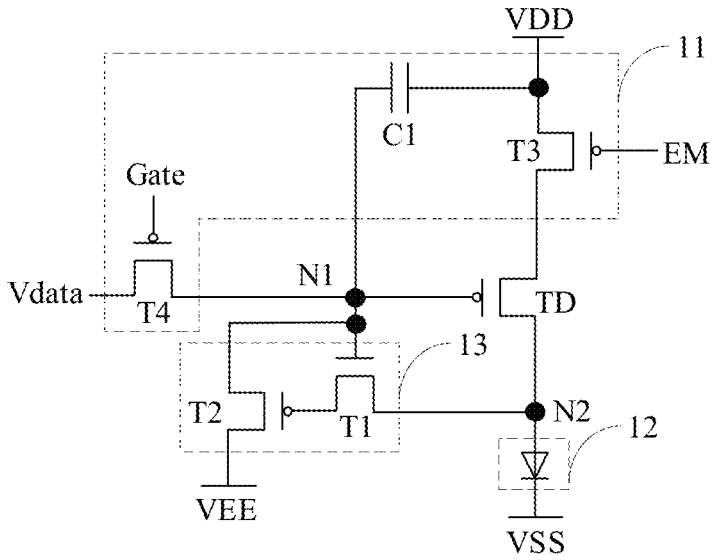
FIG. 2 is a schematic diagram showing a circuit of a pixel circuit provided by an embodiment of the present disclosure.

FIG. 2 is a schematic diagram showing a circuit of a pixel circuit provided by an embodiment of the present disclosure. As shown in FIG. 2, the short-circuit protection module 13 includes a first transistor T1 and a second transistor T2, wherein the gate of the first transistor T1 is connected to a first node N1 (i.e. the gate of the drive transistor TD), the first pole of the first transistor T1 is connected to a second node N2 (i.e. the positive pole of the light-emitting device 12), the second pole of the first transistor T1 is connected to a gate of the second transistor T2, a first pole of the second transistor T2 is connected to the first node N1, and a second pole of the second transistor T2 is connected to a third power supply voltage line (used for transmitting the third power supply voltage VEE).

In an example, device parameters of the first transistor T1 may be designed aiming to a voltage value range of the data voltage Vdata, and thus the first transistor T1 may work in the linear region or the saturation region (that is in a turn-on state) when a voltage of the gate of the first transistor T1 is equal to the third power supply voltage VEE or the data voltage Vdata with any voltage value. Thus, when the first node N1 is provided to the data voltage Vdata, the first transistor T1 is turned on, and a voltage of the second node N2 is provided to the gate of the second transistor T2. The second transistor T2 may be designed to be turned on when the voltage of the gate is roughly equal to the second power supply voltage VSS and to be turned off (that is, the second transistor T2 works in a cut-off region) when the voltage of the gate is larger than a sum of the second power supply voltage VSS and a predefined voltage threshold (such as 1.5V, 3V, 5V or 10V). Thus, when a short circuit occurs between the positive pole and the negative pole of the light-emitting device 12, the second transistor T2 is turned on, and the third power supply voltage VEE capable of driving the drive transistor TD to turn off is provided to the first node N1; and when the short circuit occurs between the positive pole and the negative pole of the light-emitting device 12, the second transistor T2 is turned off, and the third power supply voltage VEE should not influence the working state of the drive transistor TD.

It can be seen that as voltage of the second node N2 may reflect whether the short circuit occurs between the positive pole and the negative pole of the light-emitting device 12 or not and may further control the on-off state of the second transistor T2, based on the circuit structure, the detection module 13 may realize functions of short circuit detection and short circuit protection.

As shown in FIG. 2, the control module 11 includes a third transistor T3, a fourth transistor T4 and a storage capacitor C1, wherein a gate of the third transistor T3 receives a light-emitting turn-on signal EM, a first pole of the third transistor T3 is connected to the first power supply voltage line, and a second pole of the third transistor T3 is connected to the first pole of the drive transistor TD. A first end of the storage capacitor C1 is connected to the first node N1, and a second end of the storage capacitor C1 is connected to the first pole of the third transistor T3. A gate of the fourth transistor T4 receives a gate signal Gate, a first pole of the fourth transistor T4 is connected to a data voltage line, and a second pole of the fourth transistor T4 is connected to the first node N1.

In an example, the third transistor T3 may be designed to be turned on when the light-emitting turn-on signal EM is active (high or low), and the fourth transistor T4 may be designed to be turned on when the gate signal Gate is active (high or low). Thus, when the gate signal Gate is active, the fourth transistor T4 is turned on, and thus the data voltage Vdata is provided to the first node N1, and the storage capacitor C1 may store the data voltage Vdata; and then when the light-emitting turn-on signal EM is active, the third transistor T3 is turned on, the first power supply voltage VDD is provided to the first pole of the drive transistor TD, at the moment, a potential difference between the gate and the first pole of the drive transistor TD is locked by the storage capacitor C1 as Vdata-VDD, and thus the drive transistor TD provides a drive current with a current value in direct proportion to a squared value of Vdata-VDD-Vth to the light-emitting device 12. It can be seen that, based on the circuit structure, functions of the control module 11 may be realized. Noted that, the control module 11 in the embodiment adopts a circuit structure of 2T1C (that is, 2 transistors and 1 capacitor) for the purpose of describing the technical scheme of the present application only; and it should be appreciated by one skilled in art, the control module of the structure such as 6T1C and 7T1C may further implement the technical scheme of the present disclosure (referring to implementation of an OLED pixel drive circuit or an LED pixel drive circuit in the related art), and the implementation is not further described for details.

As shown in FIG. 2, illustration is made on the device type of the transistor with an example that the first transistor is a NMOS thin film transistor and other transistors are all PMOS thin film transistors in FIG. 2. For reducing the total amount of the power supply voltage lines, in the example, the third power supply voltage VEE is equal to the first power supply voltage VDD.

As the drive transistor TD is the PMOS transistor, the drive transistor TD is turned off when a difference between the voltage of the gate of the drive transistor TD and the voltage of the source is larger than an absolute value of the threshold voltage Vth, the threshold voltage Vth of the PMOS transistor is smaller than 0, and therefore, in a light-emitting phase, the drive transistor TD is turned off when the voltage of the first pole and the voltage of the gate of the drive transistor TD are both the first power supply voltage VDD, and a short-circuit current may be effectively avoided from being formed by the short circuit between the positive pole and the negative pole of the light-emitting device 12.

In an example, the data voltage Vdata may be equal to the first power supply voltage VDD in a short period of time (such as a time interval accounting for 10 percent, 15 percent or 20 percent of a duration) at the beginning of each writing phase, and therefore, the first transistor T1 may provide the voltage of the positive pole of the light-emitting device 12 to the gate of the second transistor T2 in the time interval, and the situation that the first transistor T1 belonging to NMOS cannot fully provide the voltage of the positive pole of the light-emitting device 12 to the gate of the second transistor T2 in the whole writing phase as a source-drain current formed in the first transistor T1 is too small.

Considering that the stability of the PMOS transistor is better than that of the NMOS transistor, the third transistor and the fourth transistor are the PMOS transistors in a possible implementation. Accordingly, the active levels of the light-emitting turn-on signal EM and the gate signal Gate may be both set to be low.

It should be noted that the transistor type of the drive transistor TD may be set mutually corresponding to the voltage range of the data voltage Vdata, for example, in the example, the drive transistor TD is the PMOS transistor, and the data voltage Vdata is a low-level voltage (for example, the data voltage Vdata is a voltage smaller than −3V). Alternatively, the drive transistor TD may be the NMOS transistor; and correspondingly, the data voltage Vdata is a high-level voltage (for example, the data voltage Vdata is a voltage larger than 3V), and the third power supply voltage VEE is equal to the second power supply voltage VSS; the transistor type of the first transistor T1 is adjusted according to the designed manner described above, and the transistor types of other transistors may keep invariable; and the substitutions may not have a substantial effect on the working principle and the working process of the pixel circuit.

In a possible implementation, the light-emitting device is the Micro-LED, and the structure of the light-emitting device is one of the face-up structure, the face-down structure and the vertical structure.

In a possible implementation, the light-emitting device is transferred to a backplane provided with the pixel circuit from a substrate on which the light-emitting device grows and is electrically connected to the backplane.

When the Micro-LED is of the face-up structure or the face-down structure, the pixel circuit arranged on the backplane is electrically connected to the Micro-LED through an anode-to-cathode silver gum dispensing technology.

When the Micro-LED is of the vertical structure, the pixel circuit arranged on the backplane is electrically connected to a cathode or an anode of the Micro-LED through a cathode or an anode of an entire area.

In a possible implementation, based on the pixel circuit in the embodiment, the light-emitting device is one of the Micro-LED, the Micro-OLED, the OLED and the LED.

In the embodiment, the pixel circuit in the embodiment may be used for the light-emitting devices of different types, such as the Micro-LED, the Micro-OLED, the OLED and the LED; and those skilled in the art should select a proper pixel circuit according to the actual application demand, and the detail of which is not described here.

Corresponding to the pixel circuit provided by the embodiment, one embodiment of the present disclosure further provides a driving method of the pixel circuit. As the driving method provided by the embodiment of the present disclosure may be used for any pixel circuit described above, related examples and illustrations are also suitable for the method provided by the embodiment, and details are not elaborated here.

Figure 3:
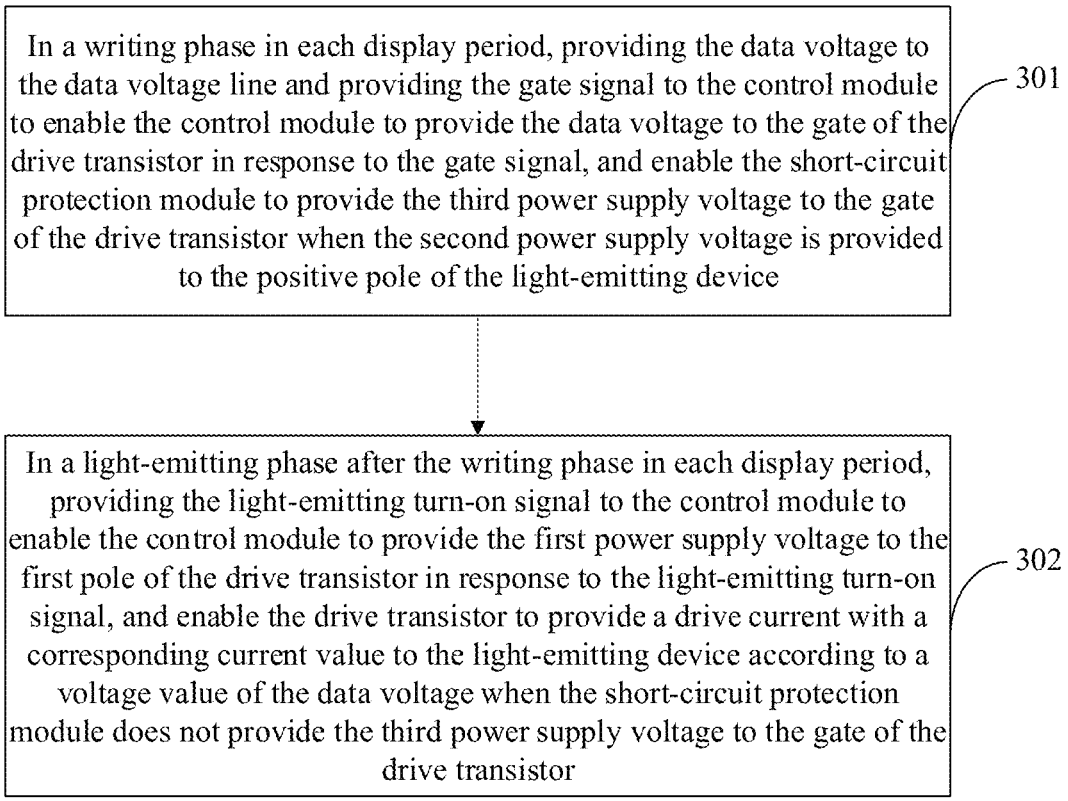
FIG. 3 is a flow diagram showing a driving method of a pixel circuit provided by an embodiment of the present disclosure.

FIG. 3 is a flow diagram showing a driving method of a pixel circuit provided by an embodiment of the present disclosure. Referring to FIG. 3, the driving method of the pixel circuit may include the following process.

In step 301, in a writing phase in each display period, the data voltage is provided to the data voltage line and the gate signal is provided to the control module to enable the control module to provide the data voltage to the gate of the drive transistor in response to the gate signal, and enable the short-circuit protection module to provide the third power supply voltage to the gate of the drive transistor when the second power supply voltage is provided to the positive pole of the light-emitting device.

In step 302, in a light-emitting phase after the writing phase in each display period, the light-emitting turn-on signal is provided to the control module to enable the control module to provide the first power supply voltage to the first pole of the drive transistor in response to the light-emitting turn-on signal, and enable the drive transistor to provide a drive current with a corresponding current value to the light-emitting device according to a voltage value of the data voltage when the short-circuit protection module does not provide the third power supply voltage to the gate of the drive transistor.

In an example, the display period may be a display frame, the writing phase and the light-emitting phase are time intervals in the display frame respectively, and the light-emitting phase is set after the writing phase. Noted that in a display apparatus including a plurality of pixel circuits, the writing phases of different pixel circuits in one display period may be different, and the light-emitting phases of different pixel circuits in one display period may also be different.

In an example, the providing the data voltage to the data voltage line includes: the data voltage with a first voltage value is provided to the data voltage line to enable the short-circuit protection module to provide the third power supply voltage to the gate of the drive transistor when the second power supply voltage is provided to the positive pole of the light-emitting device in response to the data voltage with the first voltage value; and the data voltage with the voltage value as a second voltage value is provided to the data voltage line, wherein the second voltage value is a voltage value formed based on a to-be-displayed picture. For example, the data voltage Vdata may be equal to the first power supply voltage VDD in a short period of time (such as a time interval accounting for 10 percent, 15 percent or 20 percent of a duration) at the beginning of each writing phase, and therefore, the first transistor T1 may provide the voltage of the positive pole of the light-emitting device 12 to the gate of the second transistor T2 in the time interval, and the situation that the first transistor T1 belonging to NMOS cannot fully provide the voltage of the positive pole of the light-emitting device 12 to the gate of the second transistor T2 in the whole writing phase as a source-drain current formed in the first transistor T1 is too small.

As an example, the pixel circuit as shown in FIG. 2 is taken as an example below for illustrating the working processes of the pixel circuit when the short circuit of the light-emitting device occurs and does not occur.

Figure 4:
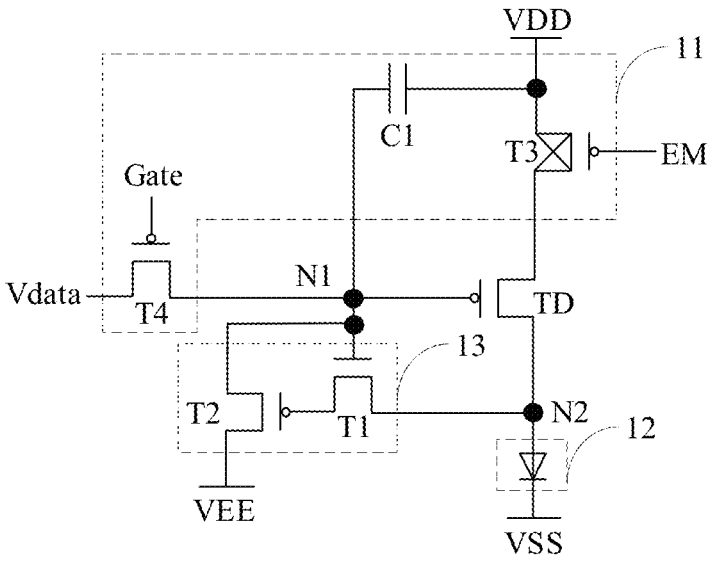
FIG. 4 and FIG. 5 are schematic diagrams showing a working state of a pixel circuit provided by an embodiment of the present disclosure in a writing phase when a light-emitting device is in a short circuit.
Figure 5:
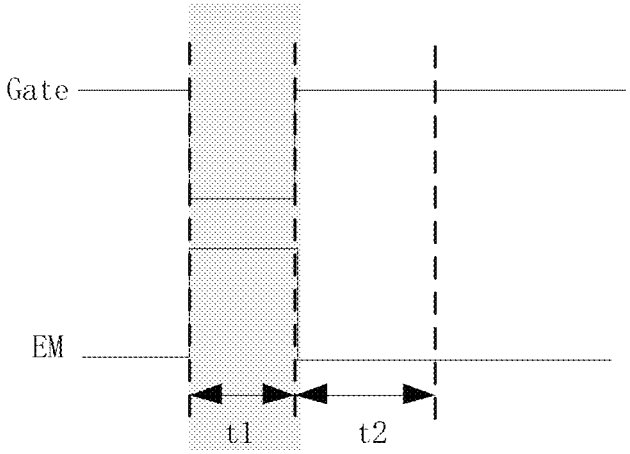

FIG. 4 and FIG. 5 are schematic diagrams showing a working state of a pixel circuit provided by an embodiment of the present disclosure in a writing phase when a light-emitting device is in a short circuit. Referring to FIG. 4 and FIG. 5, in the writing phase t1, the gate signal Gate is low, the light-emitting turn-on signal EM is high, and therefore, the fourth transistor T4 is turned on, the third transistor T3 is turned off (the cut-off state is indicated by "X"), and therefore, the data voltage Vdata is provided to a first node N1, and the first transistor T1 is turned on. At the moment, as a short circuit occurs between a positive pole and a negative pole of the light-emitting device 12, second power supply voltage VSS is provided to a second node N2; and under the effect of the turned-on first transistor T1, the second power supply voltage VSS is also provided to a gate of the second transistor T2, and the second transistor T2 is turned on. After the second transistor T2 is turned on, a third power supply voltage VEE is started to be provided to the first node N1, and thus the first node N1 provided with the data voltage Vdata and the third power supply voltage VEE at the same time reaches a balanced state (for example, being stabilized at a voltage value between the data voltage Vdata and the third power supply voltage VEE) after a period of time. In an example, the first node and the data voltage line may both reach the third power supply voltage VEE after a period of time, at the moment, a source drive sub-circuit connected to the data voltage line may detect the third power supply voltage VEE, that is the source drive sub-circuit may detect the short circuit condition of the light-emitting device 12 in the pixel circuit, the short circuit condition is recorded and/or reported by a detection result, the data voltage Vdata is stopped being provided to the data voltage line, and thus the first node N1 is stabilized at the third power supply voltage VEE finally. In the writing phase t1, the drive transistor TD may be turned on when the voltage of the first node N1 is the data voltage Vdata and may be turned off when the voltage of the first node N1 is changed to be the third power supply voltage VEE; however, whether the drive transistor TD is turned on or off, as the third transistor T3 is turned off, a drive current may not be formed between a first power supply voltage line and a second power supply voltage line.

Figure 6:
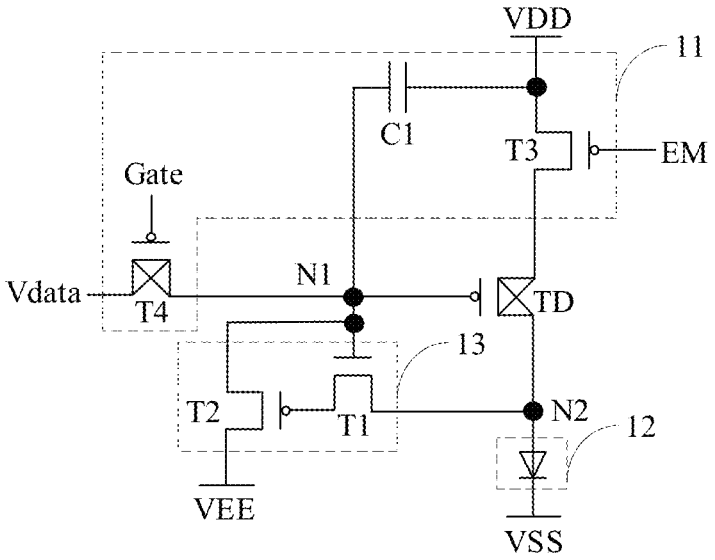
FIG. 6 and FIG. 7 are schematic diagrams showing a working state of a pixel circuit provided by an embodiment of the present disclosure in a light emitting phase when a light-emitting device is in a short circuit.
Figure 7:
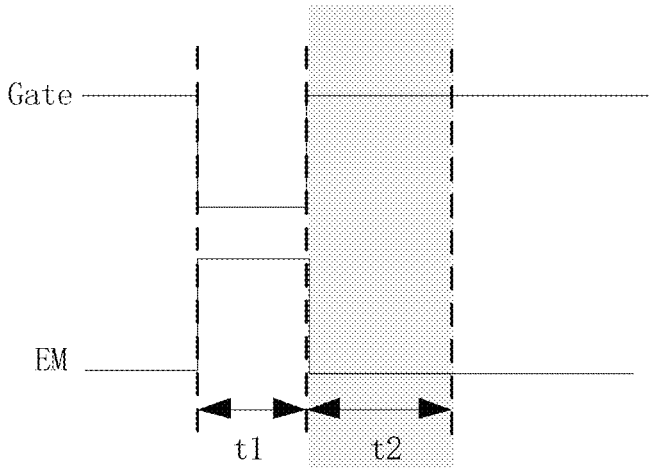

FIG. 6 and FIG. 7 are schematic diagrams showing a working state of a pixel circuit provided by an embodiment of the present disclosure in a light emitting phase when a light-emitting device is in a short circuit. Referring to FIG. 6 and FIG. 7, in the light-emitting phase t2, the gate signal Gate is high, the light-emitting turn-on signal EM is low, and therefore, the fourth transistor T4 is turned off, and the third transistor T3 is turned on. Under the effect of voltage maintenance of the storage capacitor C1, the voltage at the first node N1 may be stabilized at the third power supply voltage VEE in the last phase to enable the drive transistor TD to always work in a cut-off region, the drive current may not be formed between the first power supply voltage line and the second power supply voltage line, and thus the situation that a too large current is formed between the first power supply voltage line and the second power supply voltage line as the short circuit of the light-emitting device 12 occurs may be avoided. As the light-emitting device 12 does not emit light at the time, a subpixel corresponding to the pixel circuit may be rendered as a block point or abnormal color, the short circuit of the light-emitting device may be troubleshooted according to whether the phenomenon occurs or not in a detection phase.

Figure 8:
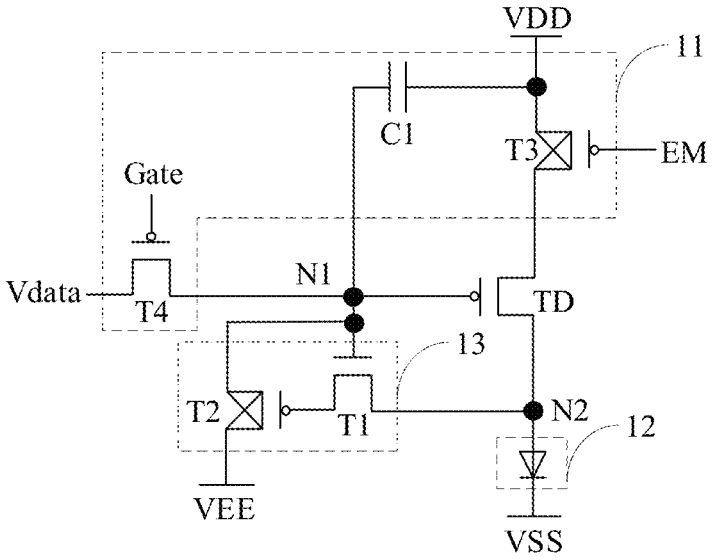
FIG. 8 and FIG. 9 are schematic diagrams showing a working state of a pixel circuit provided by an embodiment of the present disclosure in a writing phase when a light-emitting device is not in a short circuit.
Figure 9:
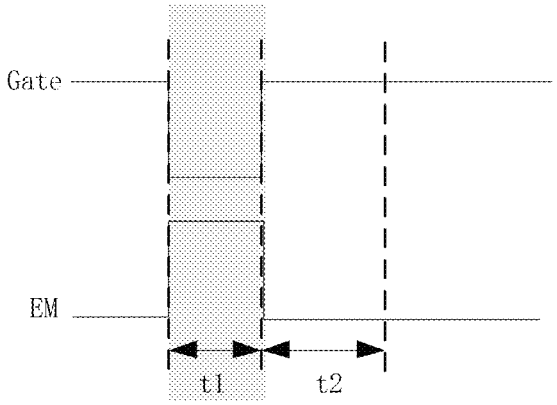

It can be seen that the short-circuit protection module 13 may lock the drive transistor TD in a cut-off state when the short circuit occurs between the positive pole and the negative pole of the light-emitting device 12 to avoid the situation that a short-circuit current is formed between the first power supply voltage line and the second power supply voltage line, and therefore, damages caused by the short circuit of a micro light emitting diode may be helped to be avoided, increase in yield of related display products is facilitated, and the safety of the display apparatus in the manufacturing and using process is improved FIG. 8 and FIG. 9 are schematic diagrams showing a working state of a pixel circuit provided by an embodiment of the present disclosure in a writing phase when a light-emitting device is not in a short circuit. Referring to FIG. 8 and FIG. 9, in the writing phase t1, the gate signal Gate is low, the light-emitting turn-on signal EM is high, and therefore, the fourth transistor T4 is turned on, the third transistor T3 is turned off (the cut-off state is indicated by "X"), and therefore, the data voltage Data is provided to a first node N1, and the first transistor T1 is turned on. At the moment, as a short circuit does not occur between the positive pole and the negative pole of the light-emitting device 12, a voltage (such as the voltage at the second node N2 in the last light-emitting phase t2) higher than the second power supply voltage VSS is provided to the second node N2; and under the effect of the turned-on first transistor T1, the voltage at the second node N2 is provided to the gate of the second transistor T2, and thus the second transistor T2 is turned off to enable the third power supply voltage VEE not to be provided to the first node N1. Therefore, under the effect of the data voltage Vdata, the storage capacitor is charged or discharged until the voltage at the first node N1 is stabilized in a state of the data voltage Vdata; and the drive transistor TD is turned on, but the drive current may not be formed between the first power supply voltage line and the second power supply voltage line as the third transistor T3 is turned off.

Figure 10:
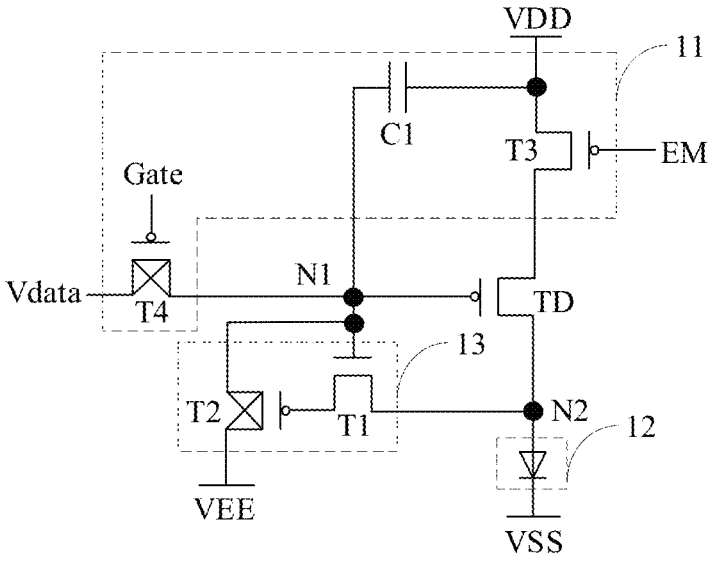
FIG. 10 and FIG. 11 are schematic diagrams showing a working state of a pixel circuit provided by an embodiment of the present disclosure in a light emitting phase when a light-emitting device is not in a short circuit.
Figure 11:
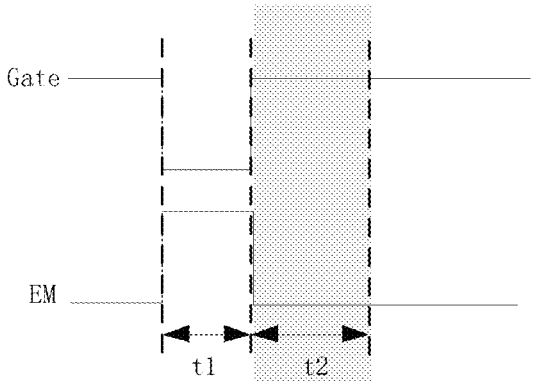

FIG. 10 and FIG. 11 are schematic diagrams showing a working state of a pixel circuit provided by an embodiment of the present disclosure in a light emitting phase when a light-emitting device is not in a short circuit. Referring to FIG. 10 and FIG. 11, in the light-emitting phase t2, the gate signal Gate is high, the light-emitting turn-on signal EM is low, and therefore, the fourth transistor T4 is turned off, and the third transistor T3 is turned on. Under the effect of voltage maintenance of the storage capacitor C1, the voltage at the first node N1 may be stabilized at the data voltage Vdata in the last phase so as to enable a voltage between the gate and the first pole of the drive transistor TD to be locked by the storage capacitor C1 to be VDD-Vdata, and therefore, a drive current with a current value in direct proportion to a squared value of VDD-Vdata-Vth may be formed, and the light-emitting device 12 emits the light according to a brightness corresponding to a current value of the drive current.

It can be seen that when a short circuit does not occur between the positive pole and the negative pole of the light-emitting device 12, the short-circuit protection module 13 may not influence normal work of the pixel circuit.

Based on the pixel circuit of the embodiment, one embodiment of the present disclosure further provides a display panel, and the display panel includes a plurality of pixel circuits of any of the above. As the display panel includes the pixel circuits, short circuit detection and short circuit protection may be performed when the short circuit of the light-emitting device occurs to avoid the situation that a product is damaged by a large current formed by the short circuit, and the yield of the products is effectively increased.

Another embodiment of the present disclosure further provides a display apparatus, and the display apparatus includes the display panel and may be any product or part with a display function, such as a mobile phone, a tablet personal computer, a television, a display, a notebook computer, a digital photo frame and a navigator.

Figure 12:
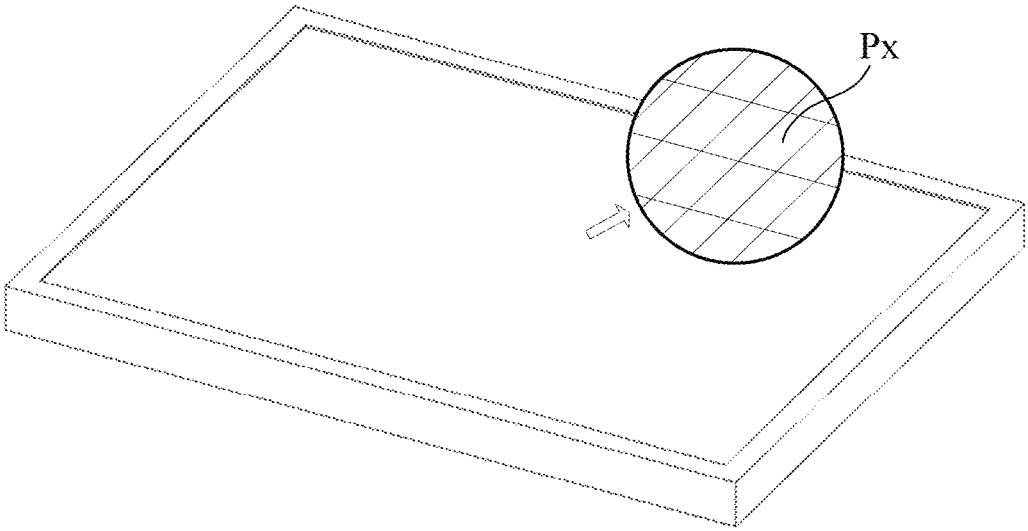
FIG. 12 is a schematic diagram showing a display apparatus provided by an embodiment of the present disclosure.
Figure 13:
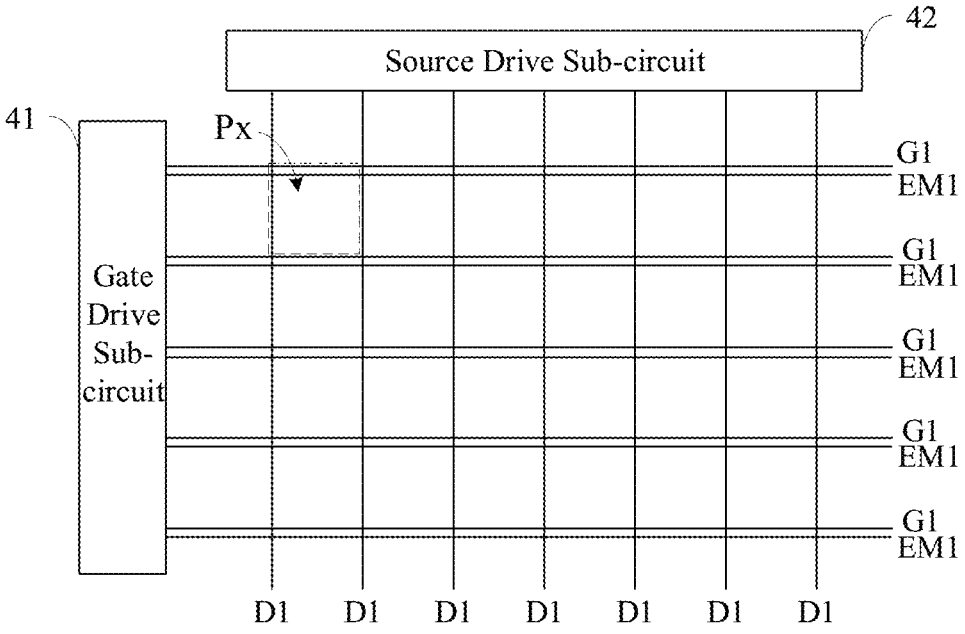
FIG. 13 is a structure block diagram showing a display apparatus provided by an embodiment of the present disclosure.

FIG. 12 is a schematic diagram showing a display apparatus provided by an embodiment of the present disclosure, and FIG. 13 is a structure block diagram showing a display apparatus provided by an embodiment of the present disclosure. Referring to FIG. 12 and FIG. 13, in an example, the display apparatus includes a plurality of subpixels Px in a display region, each subpixel Px is internally provided with a pixel circuit of any of the above (not shown in FIG. 12 and FIG. 13 for clarity of illustration). In an example, referring to FIG. 13, the display apparatus further includes a drive circuit, the drive circuit includes a gate drive sub-circuit 41 and a source drive sub-circuit 42; each pixel circuit is connected to the gate drive sub-circuit through a gate line G1 and a light-emitting turn-on signal line EM1 and is connected to the source drive sub-circuit 42 through a data line D1; and the gate drive sub-circuit 41 is used for providing a gate signal Gate thereof to each pixel circuit by the gate line G1 and providing a light-emitting turn-on signal EM1 thereof to each pixel circuit by the data line D1, the source drive sub-circuit 42 provides data voltage Vdata thereof to each pixel circuit by the data line D1, and thus the gate drive sub-circuit 41 and the source drive sub-circuit 42 are mutually matched to realize the process of the any driving method of the pixel circuit.

The above embodiments of the present disclosure are only for the purpose of clearly explaining the examples of the present disclosure, not for the limitation of the implementations of the present disclosure. For those of ordinary skill in the art, other changes or variations in different forms can be made on the basis of the above description. Here, it is impossible to enumerate all the implementations. Any obvious changes or variations derived from the technical solutions of the present disclosure are still within the protection scope of the present disclosure.

The invention claimed is:

1. A pixel circuit, comprising a control module, a drive transistor, a light-emitting device and a short-circuit protection module, wherein the control module is connected to a data voltage line, a first power supply voltage line, a gate of the drive transistor and a first pole of the drive transistor, respectively, and the control module is used for providing a data voltage on the data voltage line to the gate of the drive transistor in response to a gate signal, and providing a first power supply voltage on the first power supply voltage line to the first pole of the drive transistor in response to a light-emitting turn-on signal;

a second pole of the drive transistor is connected to a positive pole of the light-emitting device, and a negative pole of the light-emitting device is connected to a second power supply voltage line; and the short-circuit protection module is connected to a third power supply voltage line, the gate of the drive transistor and the positive pole of the light-emitting device, respectively, and the short-circuit protection module is used for providing a third power supply voltage on a third power supply voltage line to the gate of the drive transistor to turn off the drive transistor in response to the data voltage being provided to the gate of the drive transistor and a second power supply voltage on the second power supply voltage line being provided to the positive pole of the light-emitting device;

wherein the first pole and the second pole are one of a source and a drain, respectively.

2. The pixel circuit according to claim 1, wherein the short-circuit protection module comprises a first transistor and a second transistor, wherein a gate of the first transistor is connected to the gate of the drive transistor, the first pole of the first transistor is connected to the positive pole of the light-emitting device, the second pole of the first transistor is connected to the gate of the second transistor, the first pole of the second transistor is connected to the gate of the drive transistor, and the second pole of the second transistor is connected to the third power supply voltage line.

3. The pixel circuit according to claim 2, wherein the control module comprises a third transistor, a fourth transistor and a storage capacitor, wherein a gate of the third transistor receives a light-emitting turn-on signal, a first pole of the third transistor is connected to the first power supply voltage line, and a second pole of the third transistor is connected to the first pole of the drive transistor;

a first end of the storage capacitor is connected to the gate of the drive transistor, and a second end of the storage capacitor is connected to the first pole of the third transistor; and a gate of the fourth transistor receives the gate signal, a first pole of the fourth transistor is connected to the data voltage line, and a second pole of the fourth transistor is connected to the gate of the drive transistor.

4. The pixel circuit according to claim 3, wherein the drive transistor is a P-type transistor, the third power supply voltage is equal to the first power supply voltage, the first power supply voltage is higher than the second power supply voltage, the light-emitting device is one of a Micro-LED, a Micro-OLED, an OLED and a LED, and the structure of the light-emitting device is one of a face-up structure, a face-down structure and a vertical structure.

5. The pixel circuit according to claim 4, wherein the first transistor is a NMOS transistor, and the second transistor, the third transistor, the fourth transistor and the drive transistor are all PMOS transistors.

6. The pixel circuit according to claim 1, wherein the first power supply voltage is higher than the second power supply voltage.

7. The pixel circuit according to claim 1, wherein the drive transistor is the P-type transistor, and the third power supply voltage is equal to the first power supply voltage.

8. The pixel circuit according to claim 1, wherein the light-emitting device is one of the Micro-LED, the Micro-OLED, the OLED and the LED, and the structure of the light-emitting device is one of the face-up structure, the face-down structure and the vertical structure.

9. A driving method of the pixel circuit according to claim 1, comprising:

in a writing phase in each display period, providing the data voltage to the data voltage line and providing the gate signal to the control module to enable the control module to provide the data voltage to the gate of the drive transistor in response to the gate signal, and enable the short-circuit protection module to provide the third power supply voltage to the gate of the drive transistor when the second power supply voltage is provided to the positive pole of the light-emitting device; and in a light-emitting phase after the writing phase in each display period, providing the light-emitting turn-on signal to the control module to enable the control module to provide the first power supply voltage to the first pole of the drive transistor in response to the light-emitting turn-on signal, and enable the drive transistor to provide a drive current with a corresponding current value to the light-emitting device according to a voltage value of the data voltage when the short-circuit protection module does not provide the third power supply voltage to the gate of the drive transistor.

10. The method according to claim 9, wherein the providing the data voltage to the data voltage line, comprises:

providing a data voltage with a first voltage value to the data voltage line to enable the short-circuit protection module to provide the third power supply voltage to the gate of the drive transistor in response to the data voltage with the first voltage value when the second power supply voltage is provided to the positive pole of the light-emitting device; and providing data voltage with a second voltage value, wherein the second voltage value is a voltage value generated based on a picture to be displayed.

11. A display apparatus, comprising a drive circuit and a plurality of pixel circuits according to claim 1, the plurality of pixel circuits being connected to the drive circuit, wherein the drive circuit comprises:

a gate drive sub-circuit, used for providing the gate signal to the control module to enable the control module to provide the data voltage to the gate of the drive transistor in response to the gate signal and enable the short-circuit protection module to provide the third power supply voltage to the gate of the drive transistor when the second power supply voltage is provided to the positive pole of the light-emitting device in the writing phase in each display period; and a source drive sub-circuit, used for providing the data voltage to the data voltage line in the writing phase in each display period, wherein the gate drive sub-circuit is further used for providing the light-emitting turn-on signal to the control module to enable the control module to provide the first power supply voltage to the first pole of the drive transistor in response to the light-emitting turn-on signal and enable the drive transistor to provide a drive current with a corresponding current value to the light-emitting device according to a voltage value of the data voltage when the short-circuit protection module does not provide the third power supply voltage to the gate of the drive transistor in the light-emitting phase after the writing phase in each display period.

12. The display apparatus according to claim 11, wherein the source drive sub-circuit is further used for:

providing a data voltage with a first voltage value to the data voltage line to enable the short-circuit protection module to provide the third power supply voltage to the gate of the drive transistor in response to the data voltage with the first voltage value when the second power supply voltage is provided to the positive pole of the light-emitting device; and providing data voltage with a second voltage value, wherein the second voltage value is a voltage value generated based on a picture to be displayed.

13. A display apparatus, comprises a plurality of pixel circuits in a display region of the display apparatus, each of the pixel circuits comprising a control module, a drive transistor, a light-emitting device and a short-circuit protection module, wherein the control module is connected to a data voltage line, a first power supply voltage line, a gate of the drive transistor and a first pole of the drive transistor, and the control module is used for providing a data voltage on the data voltage line to the gate of the drive transistor in response to a gate signal and providing a first power supply voltage on the first power supply voltage line to the first pole of the drive transistor in response to a light-emitting turn-on signal;

a second pole of the drive transistor is connected to a positive pole of the light-emitting device, and a negative pole of the light-emitting device is connected to a second power supply voltage line; and the short-circuit protection module is connected to a third power supply voltage line, the gate of the drive transistor and the positive pole of the light-emitting device, respectively, and the short-circuit protection module is used for providing a third power supply voltage on a third power supply voltage line to the gate of the drive transistor to turn off the drive transistor in response to the data voltage being provided to the gate of the drive transistor and a second power supply voltage on the second power supply voltage line being provided to the positive pole of the light-emitting device;

wherein the first pole and the second pole are one of a source and a drain, respectively.

14. The display apparatus according to claim 13, wherein the short-circuit protection module comprises a first transistor and a second transistor, wherein a gate of the first transistor is connected to the gate of the drive transistor, the first pole of the first transistor is connected to the positive pole of the light-emitting device, the second pole of the first transistor is connected to the gate of the second transistor, the first pole of the second transistor is connected to the gate of the drive transistor, and the second pole of the second transistor is connected to the third power supply voltage line.

15. The display apparatus according to claim 14, wherein the control module comprises a third transistor, a fourth transistor and a storage capacitor, wherein a gate of the third transistor receives a light-emitting turn-on signal, a first pole of the third transistor is connected to the first power supply voltage line, and a second pole of the third transistor is connected to the first pole of the drive transistor;

a first end of the storage capacitor is connected to the gate of the drive transistor, and a second end of the storage capacitor is connected to the first pole of the third transistor; and a gate of the fourth transistor receives the gate signal, a first pole of the fourth transistor is connected to the data voltage line, and a second pole of the fourth transistor is connected to the gate of the drive transistor.

16. The display apparatus according to claim 15, wherein the drive transistor is a P-type transistor, the third power supply voltage is equal to the first power supply voltage, the first power supply voltage is higher than the second power supply voltage, the light-emitting device is one of a Micro-LED, a Micro-OLED, an OLED and a LED, and the structure of the light-emitting device is one of a face-up structure, a face-down structure and a vertical structure.

17. The display apparatus according to claim 16, wherein the first transistor is a NMOS transistor, and the second transistor, the third transistor, the fourth transistor and the drive transistor are all PMOS transistors.

18. The display apparatus according to claim 13, wherein the first power supply voltage is higher than the second power supply voltage.

19. The display apparatus according to claim 13, wherein the drive transistor is the P-type transistor, and the third power supply voltage is equal to the first power supply voltage.

20. The display apparatus according to claim 13, wherein the light-emitting device is one of the Micro-LED, the Micro-OLED, the OLED and the LED, and the structure of the light-emitting device is one of the face-up structure, the face-down structure and the vertical structure.

* * * * *